US008347786B2

(12) United States Patent
Hasselmann et al.

(10) Patent No.: US 8,347,786 B2
(45) Date of Patent: Jan. 8, 2013

(54) DOCTOR BLADE CHAMBER

(75) Inventors: Frank Hasselmann, Osnabrück (DE); Lutz Telljohann, Lengerich (DE); Frank Dirksmeier, Tecklenburg (DE); Klaus Gräler, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 851 days.

(21) Appl. No.: 11/989,017

(22) PCT Filed: Jul. 10, 2006

(86) PCT No.: PCT/EP2006/007032

§ 371 (c)(1),
(2), (4) Date: Jan. 18, 2008

(87) PCT Pub. No.: WO2007/009737

PCT Pub. Date: Jan. 25, 2007

(65) Prior Publication Data

US 2009/0266255 A1 Oct. 29, 2009

(30) Foreign Application Priority Data

Jul. 18, 2005 (DE) ..... 10 2005 034 015
Aug. 30, 2005 (DE) ..... 10 2005 040 929

(51) Int. Cl.
*B41F 31/00* (2006.01)
*B41F 31/02* (2006.01)

(52) U.S. Cl. ..... 101/350.6; 101/366

(58) Field of Classification Search ..... 101/350.6, 101/366, 169, 157; 118/410, 413
See application file for complete search history.

(56) References Cited

U.S. PATENT DOCUMENTS

| | | | | | |
|---|---|---|---|---|---|
| 5,072,669 | A | * | 12/1991 | Weisbrod et al. | 101/142 |
| 5,239,925 | A | | 8/1993 | Bobo | |
| 5,272,976 | A | * | 12/1993 | Reder et al. | 101/366 |
| 5,400,710 | A | * | 3/1995 | Ehrhard | 101/363 |
| 5,791,248 | A | * | 8/1998 | Atkins et al. | 101/350.6 |
| 6,089,159 | A | | 7/2000 | Gorter | |
| 6,799,508 | B1 | | 10/2004 | Depond | |
| 6,832,551 | B2 | | 12/2004 | Jendroska et al. | |

FOREIGN PATENT DOCUMENTS

| | | | |
|---|---|---|---|
| DE | 38 23 340 | C2 | 1/1990 |
| DE | 198 00 840 | A1 | 7/1999 |
| DE | 101 50 488 | A1 | 4/2003 |
| DE | 698 19 258 | T2 | 7/2004 |
| EP | 0 350 839 | A3 | 1/1990 |
| FR | 2 793 441 | A1 | 11/2000 |
| WO | WO 2005/063487 | A1 | 7/2005 |

* cited by examiner

*Primary Examiner* — Judy Nguyen
*Assistant Examiner* — Leo T Hinze
(74) *Attorney, Agent, or Firm* — Jacobson Holman PLLC

(57) ABSTRACT

An ink chamber doctor blade for acting upon an ink transfer roll of a rotary press with a fluid, in particular with a printing ink, has an ink chamber, which is filled with ink during printing, and which extends in an axial direction of the ink transfer roll, and two doctor blades which are in physical contact with the ink transfer roll during printing and which extend in the axial direction of the ink transfer roll. At least one additional doctor blade can be inserted into the ink chamber doctor blade and can be fixed by holding devices inside the ink chamber. The holding device has at least one element, which is pretensioned by elastic force against at least one counter holder, and with which the additional doctor blade can be pressed against the counter holder.

18 Claims, 2 Drawing Sheets

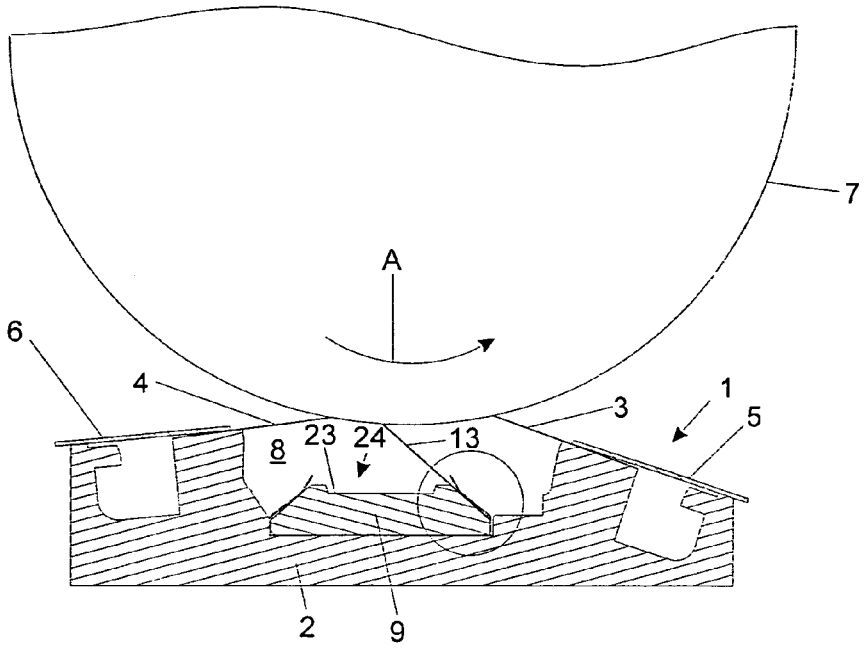
Fig. 1
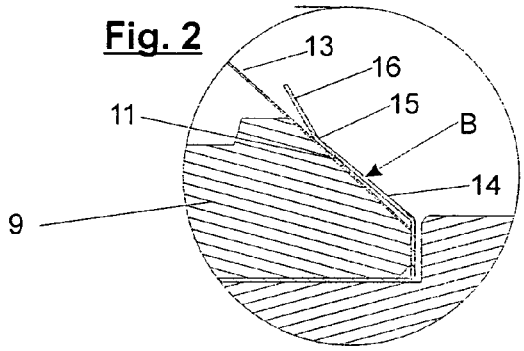
Fig. 2
Fig. 3
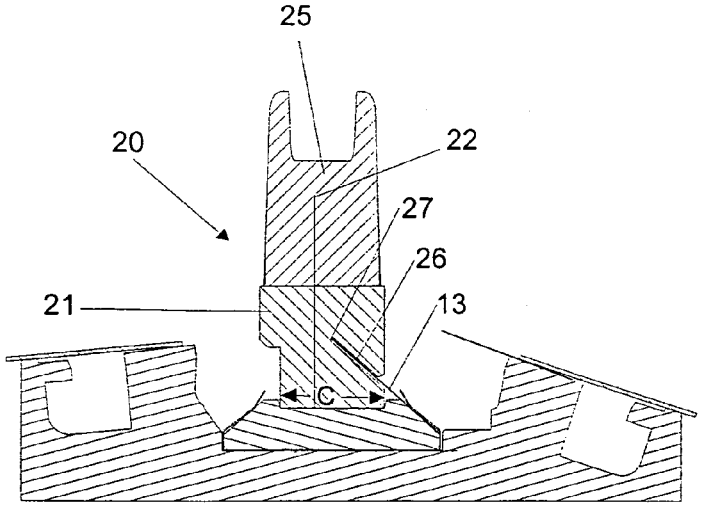

DOCTOR BLADE CHAMBER

CROSS-REFERENCE TO RELATED APPLICATION

This is a National Stage of International Application No. PCT/EP2006/007032 filed on Jul. 10, 2006 and published in German.

BACKGROUND OF THE INVENTION

1. Field of Invention

The invention relates to an ink chamber doctor blade for acting upon an ink transfer roll of a rotary press with a fluid.

2. Description of the Prior Art

Such ink chamber doctor blades are used in different types of rotary printing presses, for example in flexographic and rotogravure printing presses. These types of ink chamber doctor blades consist in general of an ink chamber extending in the axial direction of the ink transfer roll, whereby, during the printing operation, the ink chamber is filled with ink. The ink chamber doctor blade can also be filled with a different fluid, for example with a cleaning liquid, if the ink transfer rolls are to be cleaned. On the longitudinal side of this ink chamber, in general two doctor blades are attached, which are in contact with the ink transfer roll during the operation. Both doctor blades form the boundary of a gap extending in the axial direction of the ink transfer roll, through which the ink can pass on to the surface of the ink transfer roll. Further, ink chamber doctor blades are as a rule closed on the front side with sealing elements, which prevent leakage of ink from the sides. Thus the system, consisting of the ink chamber, doctor blade, ink transfer roll and the seals on the sides, forms a closed system, to which the ink is in general supplied through the feeding lines and removed through the discharge lines. During the printing operation, the ink chamber doctor blade is normally filled completely, or at least to a major part.

In the case of the flexographic printing machines, the ink transfer roll, which interacts with the ink chamber doctor blade in the manner described above, is the so-called anilox roll, which is provided with several small saucers along its outer circumference. These saucers, if they are in the area of the ink chamber doctor blade, get filled with the ink and carry the latter with it. In order to ensure that only the saucers are filled with ink and that the other areas of the exterior surface of the anilox roll also do not take up ink, this surplus ink is removed by one of the two doctor blades. This doctor blade is therefore called working doctor blade. The second doctor blade has solely the function of closing the doctor blade chamber on the outside and is called locking doctor blade. In flexographic printing method, the anilox roll transfers the ink onto the printing block affixed on the format roll, which printing blocks, on their part, deliver the ink onto the substrate to be printed. One such system has already been described in greater detail by the present applicant in the patent application DE 101 50 488 A1.

But in other printing methods also, ink chamber doctor blade/ink transfer roll-systems have been employed. For example, in rotogravure printing presses, the printing cylinder is the ink transfer roll, which takes up the ink, whereby the ink transfer roll already carries the printing blocks, which are worked in as grooves in the outer surface of the printing cylinder. The printing ink taken up by these grooves is directly applied on the substrate to be printed.

The grooves of a printing cylinder, or the saucers of an anilox roll, which have delivered their ink, bring in air into the ink chamber doctor blade, which air swirls in there and hampers refilling of the grooves or the saucers with fresh ink. This effect intensifies with increasing printing rate. For this reason, DE 38 23 340 C1 suggests that one more doctor blade be provided in the interior of the doctor blade chamber. DE 198 00 840 A1 also shows one such arrangement. On one hand, the ink chamber is subdivided into several compartments in the chamber by this or these additional doctor blade(s), so that the air-ink mixture remains in one compartment of the chamber, while in the other compartments, the saucers are completely filled with fresh ink. On the other hand, such additional doctor blades can press the ink into the saucers or the grooves.

However, in the mentioned publications, no details about the embodiments are available about how the additional doctor blades are fastened in the ink chamber doctor blade. In practice however, use of a third blade or more doctor blades is known, which are either screwed on directly or which can be held in clamped fashion by means of holding strips, whereby the holding strips are bolted with the doctor blade chamber. Dismounting and fastening of the screws for the purpose of replacement of additional doctor blades is, however, time consuming.

SUMMARY OF THE INVENTION

The aim of the present invention is to propose an ink chamber doctor blade, in which at least one more doctor blade chamber can be mounted or dismounted again with lesser effort.

This problem is solved by using an ink chamber doctor blade as described herein. The holding devices for holding at least one or more doctor blades comprise an element pretensioned by means of elastic force against at least one counter holder, with which element, the additional doctor blade can be pressed against the counter holder.

With these features of the device, the doctor blade can be fastened through application of a force acting against the elastic force, causing the pretensioned element to detach from the counter holder. The additional doctor blade can then be installed in the exterior of the counter holder. After the withdrawal of the force acting against the elastic force, the pretensioned element rests against the additional doctor blade and presses the latter against the counter holder. The counterforce against the elastic force can be applied by means of a suitable tool or even without a tool.

In similar manner, the additional doctor blade chamber can be removed. Thereby the additional doctor blade chamber can also be taken off from the counter holder by hand.

It is especially of advantage, if the counter holder is designed as a single beam extending in the axial direction of the ink transfer roll. In that case, the pretensioned element needs to be lifted off only in that area of the counter holder, in which additional doctor blades are not yet placed in the device with the counter holder. It can thus be driven with a tool, such as a screwdriver, along the counter holder and parts of the other doctor blade can be pushed in directly on the counter holder. This single counter holder can be so designed that several doctor blades can be fixed on it. An ink chamber doctor blade according to the invention can however also be operated without additional doctor blades.

In a preferred embodiment of the invention, the counter holder has a polygonal cross section, whereby at least two edges are beveled. The contour of the counter holder is thereby preferably so designed, that it can be circumscribed by a regular trapezium. Thereby the beveled edges rest against the slopes of the trapezium. On these slopes, areas of the additional doctor blades can be so situated that the doctor blades can be set up with an inclination on the ink transfer roll while getting adequate support from the counter holder and do not bend away or kink. The underside of the counter holder, which underside corresponds to the longer one of the two parallel lateral edges of the trapezium, lies on the inner floor of the ink chamber, so that the additional doctor blade assumes a certain angle with respect to the tangent of the outer circumference of the ink transfer roll. Tests have shown that the optimal angle lies between 30 and 60 degrees, in particular between 40 and 50 degrees.

In yet another embodiment of the invention, at least one counter holder is bolted from inside with the floor of the ink chamber. In this manner, through boreholes in the walls of the ink chamber can be dispensed with in the fastening of the counter holder, which would otherwise need it to be sealed in order to prevent seeping through of the ink. Such seals are always problematic and should always to be avoided.

In a preferred embodiment, the counter holder comprises a plastic material or a metal. This counter holder can be made of steel, in particular of stainless steel (for instance NIROSTA®).

An especially preferred embodiment of the invention comprises plastic or metal strips, pretensioned against the counter holder, extending in the axial direction of the ink transfer roll. One obtains a particularly simple assembly of the ink chamber doctor blade according to the invention in that the pretensioned element is an integral part of a component, which encloses at least three sides of the counter holder. These three sides are the bevels, on which the additional doctor blades lie, and underside of the counter holder, which lies on the lower plane of the ink chamber. The component is thereby preferably a chamfered plate, which, in an especially advantageous embodiment, is made of spring steel. For the fastening of the component, fastening devices are no longer necessary because it is clamped between the underside of the counter holder and the floor of the ink chamber. With this measure, the montage of the pretensioned element is simplified. Pretensioning of the element is achieved in that the beveling is done at an angle, which is smaller than the angle enclosed by the underside of the counter holder and the slanting bevels. Further, another beveling can be provided in the element pretensioned against the counter holder, so that the element is set against the counter holder along a line, in which however the line is separated by a distance from the lateral edge of the element. In this manner, a sort of funnel shape is obtained, which facilitates the pushing in of more doctor blades.

In a more advantageous embodiment, the doctor blade comprises plastic material and/or metal. The additional doctor blade, which, as described at the outset, need not seal the ink chamber doctor blade from the surroundings, can consist of a very flexible material. The flexible material can be such, for instance, that some of its areas are held in a clamped manner, while the remaining areas of the doctor blade are not yet held due to temporary formation of waves and distortions. The blade can thus be mounted segment by segment, making the assembly still easier.

Tests have shown that an additional doctor blade should be pressed against the counter holder preferably with a force between 2 and 20 N/cm, in particular with a force between 6 and 12 N/cm. The force due to the static friction, with which the doctor blade is held against the counter holder, amounts preferably between 10 and 60 N, especially between 25 and 40 N. With such a force, a secure hold of the doctor blade is ensured during the operation, yet easy removal and mounting of the doctor blade by hand, without requiring excessive exertion of a force, which can result in risks of injuries, is still possible.

Furthermore, the solution of the aforementioned problem is provided by a tool, for which an independent patent protection will be applied. This tool comprises guide elements, which can be guided at least in one complementary guide of the ink chamber doctor blade, especially in a guide support of the above described counter holder. Thereby the guide elements can be a guide profile, which can be guided in a complementary profile of the ink chamber doctor blade. The guide profile can be constructed with a rectangular cross section, whereby the complementary profile can then be a groove with studs bordering on the sides. Guide elements can however also be wheels or rolls affixed on the tool, which can traverse on rails or in slots. The guide of the ink chamber doctor blade extends in the longitudinal direction of the ink chamber doctor blade, corresponding to the axial direction of the ink transfer roll, on which the ink chamber doctor blade can be adjusted.

Further, this tool comprises devices for enabling actuation of a force on the lateral edge of the doctor blade, in particular on the edge of the third or other additional doctor blade(s). Here too, lateral edge means that edge, which extends in the longitudinal direction of the blade or the ink chamber doctor blade. By guiding the tool along the guide supports, a force is exercised against some areas of the lateral edge of the doctor blade, which can be used to press the blade against a resistance and/or to overcome that resistance. This tool is preferably used for inserting an additional, not sealing, doctor blade into the holding device of the above described ink chamber doctor blade, without requiring taking off of the pretensioned element from the counter holder using an additional tool.

It is especially advantageous, if the devices for enabling actuation of a force on the lateral edge of the doctor blade grip a body, which is provided with a groove. The body is to be attached on the doctor blade so that the groove encloses the doctor blade at least partially. By guiding the body along the doctor blade or by guiding the guide elements in the guide, the floor of the groove can exercise a force on the lateral edge of the doctor blade. The depth of the groove is so selected that the doctor blade does not try to swerve away due to the twists caused by the action of the force.

Thereby, preferably the body is made of a plastic material, in particular of a plastic material, which contains polytetrafluoroethylene, known as TEFLON®. Such a plastic material has high elastic strength, but only small static friction. But other synthetics can also be used, for example, polyethylene.

Other exemplary embodiments of the invention follow from the subjective description and the claims.

BRIEF DESCRIPTION OF THE DRAWINGS

The individual figures show:

FIG. 1A section through an ink chamber doctor blade/ink transfer roll arrangement during printing operation.

FIG. 2 Magnified image of the circled section shown in FIG. 1.

FIG. 3 A section through an ink chamber doctor blade according to the invention with the mounted tool.

DETAILED DESCRIPTION OF THE PREFERRED EMBODIMENTS

Further scope of applicability of the present invention will become apparent from the detailed description given herein-after. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 4:
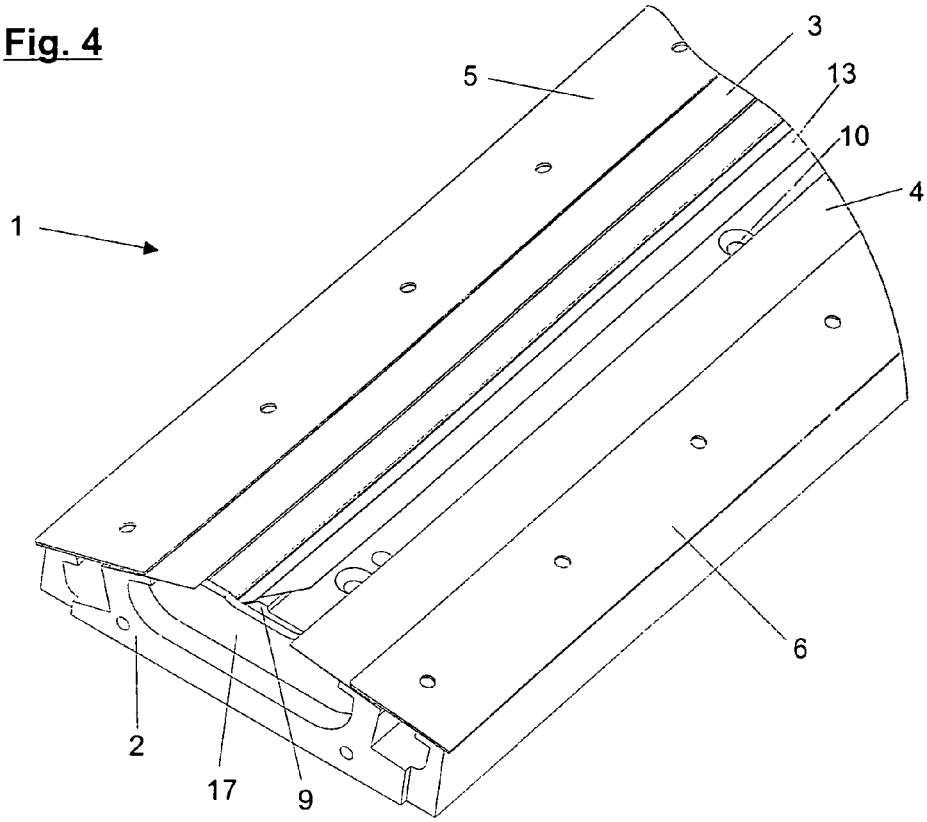
FIG. 4 Perspective view of an ink chamber doctor blade according to the invention.
Figure 5:
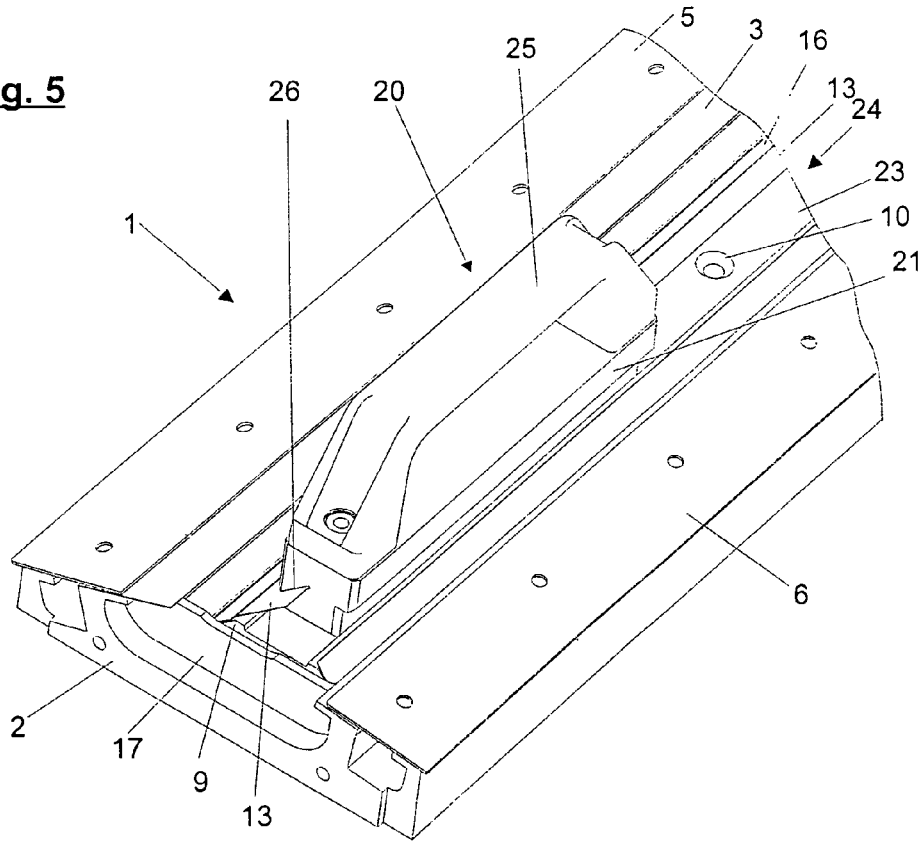
FIG. 5 Perspective view of an ink chamber doctor blade according to the invention with the sliding tool.

FIG. 1 shows an ink chamber doctor blade 1, which comprises an ink chamber 2. On the ink chamber 2, two doctor blades 3, 4 are fitted on and are fastened in the ink chamber 2 by means of clamping rails 5, 6. Doctor blades 3, 4 are in contact with the ink transfer roll 7, so that the doctor blades 3, 4, ink chamber 2 and the ink transfer roll 7 circumscribe a cavity 8. On the facing sides of the ink chamber 2, the seals 17 shown in FIGS. 4 and 5 circumscribe the cavity 8. During the printing operation, the cavity 8 is in general filled completely or at least for the major part with ink. The direction of the rotation during a printing operation of the ink transfer roll 7, which can be an anilox roll, is symbolized by arrow A.

Within ink chamber 2, a beam-shaped counter holder 9 is arranged in the axial direction of the ink chamber doctor blade 1. The ink chamber has a groove in its floor, extending in the axial direction, in which the counter holder 9 can be admitted. For fastening the counter holder 9, the latter is provided with through boreholes 10, through which screws, not shown in the figures, can be inserted, and which, on their part, can be tightened in the corresponding tapped blind boreholes of the ink chamber 2. In the embodiment shown, the counter holder 9 is provided with a polygonal cross section. The base area, which rests on a plane of the ink chamber 2, is connected with the lateral areas, which are essentially arranged perpendicular to the base area. On the lateral surfaces of the counter holder 9 border the slanting surfaces 11, 12, on each of which, an additional doctor blade 13 can be fitted, and which lie in planes, which run along the axial extension of the ink transfer roll 7, but are inclined at a certain angle with respect to the radial direction of the ink transfer roll 7. In each case, the angle of inclination of both slants can be the same or also different. The angle of inclination is defined as the angle between the tangent at that point in the outer periphery of the ink transfer roll, where the additional doctor blade 13 is situated, and the plane of the slanting surfaces 11, 12. The additional doctor blade 13 is held in the device at the slanting surface 11 by a clamping element 14. This clamping element 14 is pretensioned elastically against the slanting surface 11. The direction of this elastic force is indicated by the arrow B (see FIG. 2). In addition to that, the clamping element 14 is provided with an edge 15, so that the clamping element 14 is supported at the counter holder 9 or the additional doctor blade 13 along the line extending in the axial direction of the ink transfer roll 7. The edge 15 is so designed that the end part 16 of the clamping element 14 protrudes from the slanting surface 11 of the counter holder 9 and forms a funnel shape with it, in which the additional doctor blade 13 can be pushed in during the assembly.

At the slanting surface 12 also, a clamping element is provided, which can serve the purpose of fixing one more doctor blade. The shown ink chamber doctor blade can be operated with no additional, with one additional or with two additional doctor blades. Both clamping elements are furnished using a plate, which is guided around the underside of the counter holder, so that the clamping elements can also be fixed along with the fastening of the counter holder 9 in the ink chamber 2.

FIG. 3 shows an ink chamber doctor blade 1, which was removed from the ink transfer roll and in which the additional doctor blade is replaced by a new one. In order to slide on the new doctor blade 13 on the slanting surface 11 so far that the doctor blade 13 reaches at least below the edge 15 of the clamping element 14, a sliding tool 20 is used. The latter consists of a body 21, which comprises a lower, plane surface 22 with a certain width C. That surface 22 of the sliding device 20 rests on a plane surface 23, also plane, of a groove 24, extending in axial direction, in the counter holder.

The width of the groove is thereby minimally larger than the width C of the surface 22, so that the sliding tool 20 can be guided in a straight-line course along the groove 24. The operator can thereby exert a pressing force on the sliding tool using a handle 25, so that it always rests with its surface 22 on surface 23. The body 21 has a groove 26 in one of its lateral areas, which are inclined at a slope relative to the lateral area of the body. Thereby the lower inner area of the groove 26 lies in the plane of the slanting surface 11, if the surface 22 of the sliding tool 20 rests completely on surface 23. The depth of the groove is thereby so dimensioned that the width of the doctor blade 13 is larger than the distance between the edge 15 and the floor 27 of the groove.

The shown sliding tool 20 comprises only one groove. For mounting an additional doctor blade on the slanting surface 12, the sliding tool 20 is simply turned by 180 degrees, and set again on surface 23. Conceivable is, however, also a sliding tool with two or more grooves, so that several doctor blades can be mounted in a single processing step.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Symbols | |
|---|---|
| 1 | Ink chamber doctor blade |
| 2 | Ink chamber |
| 3 | Doctor blade |
| 4 | Doctor blade |
| 5 | Clamping rail |
| 6 | Clamping rail |
| 7 | Ink transfer roll |
| 8 | Cavity |
| 9 | Counter holder |
| 10 | Through borehole |
| 11 | Slanting surface |
| 12 | Slanting surface |
| 13 | Additional doctor blade |
| 14 | Clamping element |
| 15 | Edge |
| 16 | End part of the clamping element |
| 17 | Sealing |
| 18 | |
| 19 | |
| 20 | Sliding tool |
| 21 | Body |
| 22 | Plane area |
| 23 | Surface |
| 24 | Groove |
| 25 | Handle |
| 26 | Slot |
| 27 | Floor of the slot |
| A. | Direction of rotation of ink transfer roll |
| B. | Direction of the elastic force |
| C. | Width of the area 22 |

What is claimed is :

1. An ink chamber doctor blade for acting upon an ink transfer roll of a rotary printing press with a fluid, in particular with printing ink, comprising:

an ink chamber, which is filled with ink during printing, extending in an axial direction of the ink transfer roll;

a first and a second doctor blade, which are in physical contact with the ink transfer roll and which extend in the axial direction of the ink transfer roll; and at least a third doctor blade that is inserted into the ink chamber doctor blade and fixed in place with holding devices inside the ink chamber, the holding devices including at least one element that (i) is pretensioned by an elastic force against at least one counter holder and (ii) presses the third doctor blade against the counter holder, the element enclosing at least three external surfaces of the counter holder.

2. The ink chamber doctor blade according to claim 1, wherein the at least one counter holder is a single beam extending in the axial direction of the ink transfer roll.

3. The ink chamber doctor blade according to claim 1, wherein the at least one counter holder has a polygonal cross section, in which at least two edges are beveled.

4. The ink chamber doctor blade according to claim 1, wherein the at least one counter holder has at least one groove, extending in the axial direction of the ink transfer roll, in a surface of the counter holder that faces the ink transfer roll.

5. The ink chamber doctor blade according to claim 1, wherein the at least one counter holder is connectable with the ink chamber from within the ink chamber.

6. The ink chamber doctor blade according to claim 1, wherein the at least one counter holder has a material of construction that is at least in part at least one of a plastic and a metal.

7. The ink chamber doctor blade according to claim 1, wherein the element pretensioned against the counter holder includes a plastic or a metal strip extending in the axial direction of the ink transfer roll.

8. The ink chamber doctor blade according to claim 1, wherein the element pretensioned against the counter holder stands in contact along a line with the third doctor blade or with the counter holder.

9. The ink chamber doctor blade according to claim 1, wherein the third doctor blade has a material of construction that is, at least in part, at least one of a plastic and a metal.

10. The ink chamber doctor blade according to claim 1, wherein the elastic force lies between 2 and 20 N/cm.

11. The ink chamber doctor blade according to claim 10, wherein the elastic force is between 6 and 12 N/cm.

12. The ink chamber doctor blade according to claim 1, wherein the third doctor blade is held by the counter holder with a static frictional force of from 10 to 60 N.

13. The ink chamber doctor blade according to claim 12, wherein the static frictional force is of from 25 to 40 N.

14. An ink chamber doctor blade for acting upon a fluid of an ink transfer roll of a rotary printing press, said ink chamber doctor blade comprising:

an ink chamber extending in an axial direction of the ink transfer roll;

a first and a second doctor blade in contact with the ink transfer roll and extending in the axial direction of the ink transfer roll;

a counter holder configured to hold a third doctor blade in contact with the ink transfer roll, the counter holder having a cross-sectional shape that corresponds substantially to that of a regular trapezium and that includes (i) at least two angled sides and (ii) a bottom side, which corresponds to a longer one of two parallel lateral sides of the trapezium, that contacts an inner floor of the ink chamber; and a holding element pretensioned by an elastic force so as to press the third doctor blade against the counter holder, the holding element contacting the third doctor blade or the counter holder along an edge of the holding element, and enclosing at least three external sides of the counter holder, including the two angled sides and the bottom side.

15. The ink chamber doctor blade according to claim 14, wherein the holding element is configured as an angled plate having a spring steel material of construction.

16. The ink chamber doctor blade according to claim 14, wherein the holding element is an integral component having at least three sections, including a first and a second angled side section, each of which is associated with a respective one of the two angled sides of the counter holder, and a bottom section, which is associated with the bottom side of the counter holder.

17. The ink chamber doctor blade according to claim 16, wherein the holding element is configured such that an angle between each of the first and second angled side sections and the bottom section is smaller than an angle between each of the two angled sides and the bottom side of the counter holder.

18. An ink chamber doctor blade for acting upon an ink transfer roll of a rotary printing press with a fluid, in particular with printing ink, comprising:

an ink chamber, which is filled with ink during printing, extending in an axial direction of the ink transfer roll;

a first and a second doctor blade, which are in physical contact with the ink transfer roll and which extend in the axial direction of the ink transfer roll; and at least a third doctor blade that is inserted into the ink chamber doctor blade and fixed in place with holding devices inside the ink chamber, the holding devices including at least one element that (i) is pretensioned by an elastic force against at least one counter holder and (ii) presses the third doctor blade against the counter holder, the element being in contact along a line with the third doctor blade or with the counter holder.

* * * * *